United States Patent [19]

Pedersen et al.

[11] Patent Number: 4,688,362

[45] Date of Patent: Aug. 25, 1987

[54] SET OF MODULAR BUILDING CONSTRUCTION ELEMENTS

[75] Inventors: Morten C. Pedersen, Mont-la-Ville; Jean-Jacques Meylan, L'Abbaye, both of Switzerland

[73] Assignee: Constro S.A., Mont-la-Ville, Switzerland

[21] Appl. No.: 846,262

[22] Filed: Mar. 31, 1986

[30] Foreign Application Priority Data

Apr. 1, 1985 [CH] Switzerland ..... 1406/85

[51] Int. Cl.[4] ..... E04B 1/10; F04C 3/292

[52] U.S. Cl. ..... 52/227; 52/233; 52/286; 52/586; 52/591

[58] Field of Search ..... 52/227, 233, 286, 591, 52/586

[56] References Cited

U.S. PATENT DOCUMENTS

| | | | |
|---|---|---|---|
| 669,591 | 3/1901 | Penney | 52/286 X |
| 1,385,606 | 7/1921 | Christensen | 52/227 |
| 1,397,976 | 11/1921 | McAvoy | 52/227 |
| 1,671,279 | 5/1928 | Friedland | 52/286 X |
| 2,204,675 | 6/1940 | Grunert | 52/586 |
| 2,291,712 | 8/1942 | Hatton | 52/227 X |
| 2,387,659 | 10/1945 | Hafsos | 52/227 |
| 2,902,853 | 9/1959 | Lofstrom | 52/286 |
| 3,305,982 | 2/1967 | Steele | 52/286 X |
| 3,449,875 | 6/1969 | Snedeker | 52/227 |
| 3,527,005 | 9/1970 | Slavens | 52/227 |
| 3,849,960 | 11/1974 | Henry | 52/233 X |
| 4,550,543 | 11/1985 | Valenzano | 52/586 X |

FOREIGN PATENT DOCUMENTS

| | | | |
|---|---|---|---|
| 7630 | 2/1980 | European Pat. Off. . | |
| 2308559 | 8/1973 | Fed. Rep. of Germany | 52/591 |
| 2231239 | 12/1974 | France | 52/591 |
| 2237027 | 2/1975 | France | 52/591 |
| 21631 | of 1895 | United Kingdom | 52/286 |
| 790977 | 2/1958 | United Kingdom | 52/233 |
| 2091777 | 8/1982 | United Kingdom . | |

*Primary Examiner*—Alfred C. Perham

*Attorney, Agent, or Firm*—Anthony J. Casella; Gerald E. Hespos

[57] ABSTRACT

The set is composed of elements of six types (1 to 6) of different lengths and conformations, all having transverse interengaging tongues (7) and complementary grooves (8) and a dovetail slideway (9) at each end intended for their coupling to each other in their lengthwise direction.

Certain elements (2, 3, 5, 6) furthermore have female dovetail slideways (9) on their side faces, intended for L, T and crosswise wall connections, as well as a hole (11) for the passage of a threaded rod and the containing of a centering sleeve.

Ths set of elements has the specific feature that it makes it possible to reproduce, in all wall conformations and independently of the openings (25), a vertical alignment of the slideways (9) with a repetitive pitch (P) which visually reestablishes wall continuity despite the discontinuity due to the stagger of the joint lines (28) of the elements.

3 Claims, 8 Drawing Figures

SET OF MODULAR BUILDING CONSTRUCTION ELEMENTS

The object of the present invention is a set of modular elements for the construction of building walls, having rectangular parallelepiped shapes, of the same height and same width, of different lengths and types and having connecting and/or retaining conformations formed of grooves and tongues of complementary cross sections and of vertical recesses or passages intended for additional vertical connecting elements formed of threaded rods, connecting sleeves, washers and lock nuts.

A set of construction elements of this type has already been developed in order to facilitate the erection of building walls by the assembling of these elements without the use of binders such as mortar or cement and without requiring the use of highly skilled labor.

In said known set of construction elements, described in the British Patent Application published under No. 2 091 777, each of these elements has complementary transverse relative positioning rectangular grooves and tongues intended to assure their alignment in the lengthwise direction of the wall and the vertical alignment of these elements is assured by vertical threaded rods along which they are threaded upon the mounting of each of their horizontal rows. The interlocking of the elements in the lengthwise direction of the wall is assured by lower and upper connections of threaded rods formed respectively of continuous foundation elements and by continuous cornice beams which have the effect of blocking said rods in their relative spaced positions.

The elements of one row rest on those of the lower row without interpenetrating conformations and without the interposition of sealing means, the sealing being assured by the clamping of these elements between the foundation and the cornice beams by means of bolts, washers and nuts. In order to avoid the handling of bolts of great length, internally threaded connecting sleeves are provided for the connecting together of short threaded rod sections which can thus be connected as the horizontal rows of elements are assembled. The surface of the visible side faces of the elements is without any interruption so as to obtain the appearance of single-piece walls. On a side face, within the building, of certain elements there is merely provided a vertical dovetail groove intended to permit the interengaging of a profiled member by pressure so as to facilitate the subsequent attachment of a facing such as a wall covering.

The modular construction elements of this known set are of three principal types: A corner element for L connections of walls and a solid wall element which are treated as hollow heat-insulation bodies each having at least one vertical hole for the passage of a threaded rod and a wall element comprising a series of holes for the passage of at least one threaded rod, which may be cut as desired into the desired length in order to constitute the limiting edge of an opening such as a window or a door.

In this known set of modular construction elements, the tightness of the walls to the weather and, in particular, to entrance of water, aside from the application of plaster, is a function only of the quality of the planarity from one element to the next. Furthermore, this set of elements does not have connecting means other than those intended for the wall L-corner junctions.

In a second known set of construction elements, described in the European Patent Application published under No. 0 007 630, which is also designed to facilitate the erecting of building walls without the use of binders, the elements of each of the successive rows are interlaced with each other by means of a dovetail assembly, in the form of complementary grooves and tongues arranged alternately on two ends of these elements, ribs with their complementary grooves being furthermore provided on the corresponding longitudinal edges of these elements so that the blocks of one row can fit on those of the lower row. Certain elements of this set are intended for L wall corner connections and for this purpose have dovetail assembly elements also on one side of one end; other elements have there two sides of an end for T wall connections. Here also, as in the first set of elements already mentioned, the surface of the visible side faces of the elements is without interruption.

In this second set of construction elements, use is no longer made of vertical threaded rods passing through holes in the elements as a result of the imbrication of the elements in the longitudinal direction of the wall and their interengagement of one row on the next but, on the other hand, with respect to the corners of buildings constructed with such a set of elements, the set includes corner elements which have the characteristic of creating between them a continuous vertical hollow space which can be filled with reinforced concrete. The tightness from one row of elements to the next is assured here in efficient manner by the interengagement of the complementary tongues and grooves of their longitudinal edges. However, due to the absence of vertical connections such as the threaded rod of the first-mentioned set of elements, at least the angle connections of the corners of the building must be assured in the vertical direction by the insertion of iron reinforcement bars and the pouring of cement in the elements contemplated for this purpose, this work requiring the use of skilled labor.

In these two known sets of construction elements, which are designed to be made preferably of stone, concrete or baked clay, or else of synthetic materials for the second one, the assembling of the elements of a wall shows the boundaries of their joints and this creates a visual discontinuity in the facade, which is worsened by the irregularities of the joint lines, which can be eliminated only by the application of covering materials such as plaster or coatings, which application requires the use of skilled labor.

In certain wooden building structures, such as, for instance, certain mountain or vacation houses, use is made of prefabricated timbers which are adapted to be assembled on the spot. These timbers are of the same length and the same height and have, here also, at their ends and along their lower and upper edges assembly conformations formed of complementary ribs and grooves intended, by their free interengagement in one another, to facilitate their assembling and their alignment. Timbers of this kind are described in, among other documents, Swiss Pat. No. 364 624 as well as German Published Patent Application 32 10 925. However, these timbers do not have special expedients which permit the crosswise assembling of several of them, as for instance at right angles to the wall connections, and these connecting expedients, which are generally formed of complementary cuts, must be made on the spot, preferably by a skilled carpenter, or at least under his supervision.

Within the field of a set of modular elements for the construction of building walls of the type mentioned at the start hereof, the object of the invention is to further increase the ease of assembling these elements without the use of binder, by a more elaborate prefabrication and a judicious selection of their various types in such a manner that any unskilled person can assemble walls and partitions without touch-up or repair work or the use of skilled labor, both for the assembling of continuous walls and for the assembling of L-shaped, T-shaped and +-shaped wall junctions, which is applicable to all materials and in particular wood, further increasing the reliability of the self-retaining systems of the elements to each other in their lengthwise direction and without, however, resulting in any impairment of the appearance of the building as a result of the assembling of these elements.

For this purpose, the set of modular elements for the construction of building walls in accordance with the invention is characterized by the fact that it comprises six different types of elements, all having in common on the longitudinal edges of their upper and lower horizontal faces complementary interengaging longitudinal tongues and grooves, forming transverse retentions and sealing conformations and at least one parallel vertical coupling slideway at each end intended for their imbrication and their coupling to each other in their lengthwise direction; by the fact that the elements of the first type, known as "short filling elements," are of square horizontal section and have on their two opposite ends alternate parallel coupling vertical slideways, one female at one end and the other one male at the other end; by the fact that the elements of the second type known as "short connecting elements" are also of square horizontal section, having on their two ends and their two vertical faces at least one female parallel coupling vertical slideway and a central vertical hole for the passage of a vertical threaded connecting rod; by the fact that the elements of the third type known as "medium connecting elements" are of rectangular horizontal section and each corresponds in volume and in conformation to the combining of a short filling element of the first type with a short connecting element of the second type; by the fact that the elements of the fourth type known as "long filling elements" are of rectangular horizontal section and have their parallel coupling vertical slideways in male conformation at their two ends; by the fact that the elements of the fifth type, known as "long connecting elements," are of rectangular horizontal section and each corresponds in volume and in conformation to the combining of a long filling element of the fourth type with a short connecting element of the second type; by the fact that the elements of the sixth type, known as "double connecting elements," are of rectangular horizontal section and each corresponds in volume and in conformation to the end-to-end assembly in sequence of a long connecting element of the fifth type, a short connecting element of the second type except for its central vertical hole, and a long filling element of the fourth type; and by the fact that the connecting elements of the second, third, fifth and sixth types all have, above their female parallel coupling vertical slideways and on their horizontal faces provided with longitudinal grooves, transverse cuts which are intended, in the wall junctions and angle connections, for the passage of the corresponding tongues of the elements which are crosswise to them.

In this way, the combination of the longitudinal connecting means formed by the parallel coupling vertical slideways of the ends of the elements with the vertical connecting bolts from one row of elements to the next reinforces the longitudinal retaining of the elements of a row and facilitates the precision of the positioning thereof with respect to the lower row.

The combination of the two filling elements with the four connecting elements and their dimensional ratios which result from their correspondences to selected assemblies between them makes it possible to assure, without repair work or retouch work, particularly when the set is made of wood, all L-shaped, T-shaped or crosswise connections. In particular, T and crosswise connections can be made substantially in the central region of the double connecting elements of the sixth type without it being necessary at this level to reinforce the vertical and longitudinal connections by a vertical threaded rod. In the angular L-shaped connections, the elements of one row can be crossed with those of the lower row without this method of crossing emphasizing unesthetically and unpleasantly to the eye the discontinuity of the vertical joint lines. In fact, the combination of the dimensional ratios of the elements makes it possible to have there appear on the assembled walls a vertical alignment of all the female parallel coupling vertical slideways which is repeated regularly in accordance with a pitch which is a function of the length imparted to the long filling elements of the fourth type, this effect resulting from the rule taught for the dimensional determination of the connecting elements and this apparent pitch creates a visual continuity which makes one forget the discontinuity of the vertical lines of the joints of the elements, the latter being of a far smaller size in space than that of the female parallel coupling vertical slideways.

The accompanying drawing shows, by way of example, one embodiment of the object of the invention, a variant thereof, as well as two variants of a special conformation of some of its elements.

Figure 2:
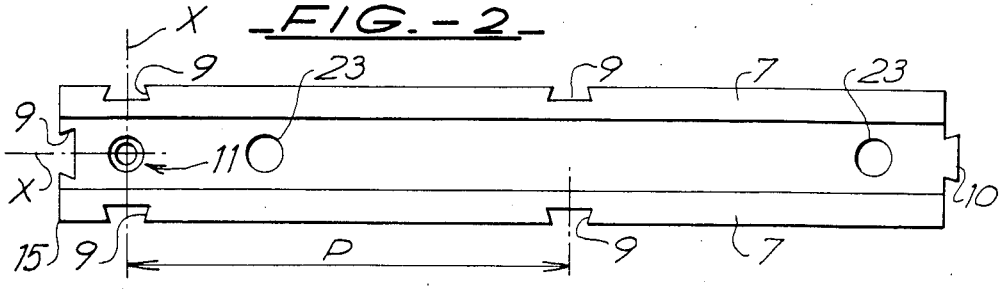
FIG. 2 is a bottom view, seen along the arrow f of FIG. 1.
Figure 1:
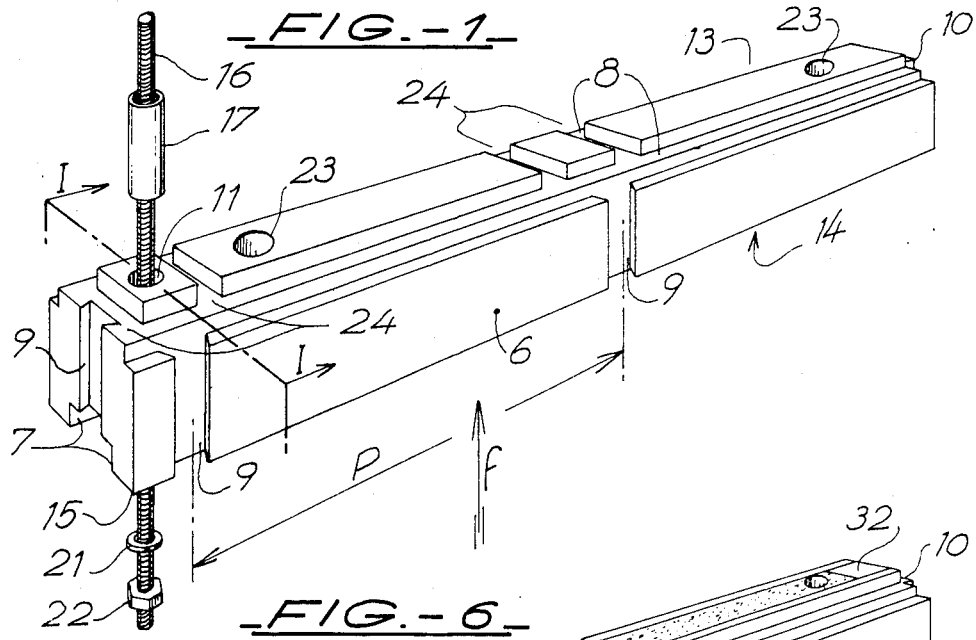
FIG. 1 is a perspective view of one of the elements of this object.
Figure 4:
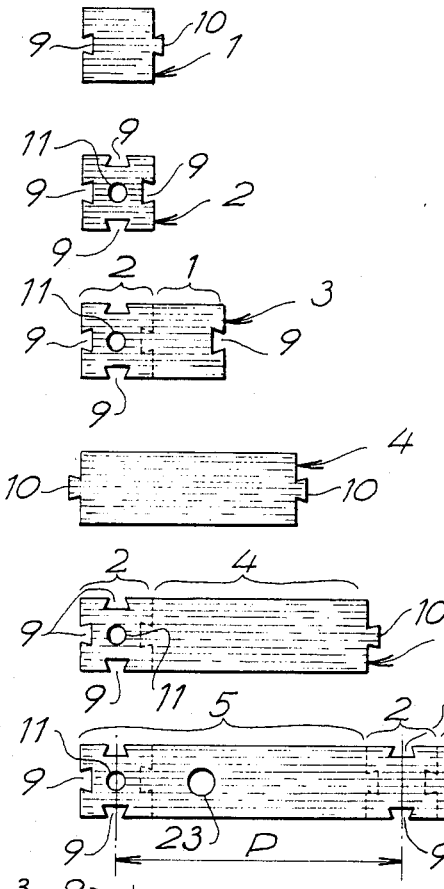
FIG. 4 is a diagrammatic plan view of the six types of elements of the set which constitutes the object of the invention.
Figure 3:
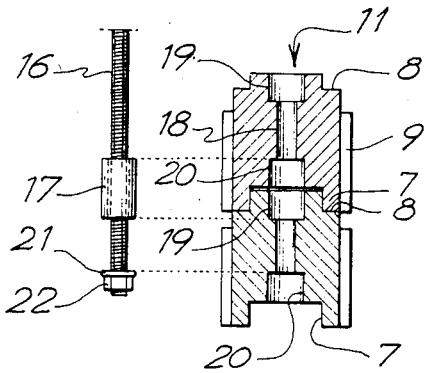
FIG. 3 is a cross section through the assembly of two of these elements, along the section line I—I of FIG. 1.

The construction element shown in FIGS. 1, 2 and 3 is of the sixth type of the six types of elements constituting the set shown in FIG. 4 and which bears the number 6.

This element, known as a "double connecting element," has in common with all the elements of the set that it is of rectangular parallelepiped shape and comprises, on the longitudinal edges of its two horizontal faces 13 and 14, complementary interengaging longitudinal tongues 7 and grooves 8 forming transverse retainers and tightness conformations upon the assembling of two superimposed elements, shown in FIG. 3, the tongues 7 protruding on the two edges of the lower horizontal face 14 and the grooves 8 being recessed in the edges of the upper horizontal face 13.

Like all the other elements of the set, this element 6 has at its two ends a parallel coupling vertical slideway, conceived here as a dovetail, these slideways being one female 9 on the left-hand side of the drawing and the other male (10) on the right-hand side, as is clearly visible in FIG. 2.

This element 6 furthermore has on its two side vertical faces two vertical female dovetail slideways 9 spaced apart by a distance P, establishing a pitch which will be referred to further below, and this in such a manner that the two slideways located on the side of the end of the element also having a female dovetail slideway 9 are at the same distance as the latter from to the vertical edge 15 defining this end of these two faces, as can be noted from FIG. 2. At the intersection of the axes of symmetry X of these female dovetail slideways 9 this element 6 has a central vertical hole 11 provided for the passage of a threaded vertical connecting rod 16 and the recess for a centering sleeve 17, the conformation of which is shown in detail in FIG. 3.

This vertical hole 11 has a central portion 18 of functional diameter which permits the easy passage of the threaded rod 16, and two end debouching counterbores 19 and 20 of a diameter substantially equal to that of the centering sleeve 17, these parts of the hole 11 being defined by two shoulders resulting from their difference in diameter. The sum of the lengths of the two counterbores 19 and 20, taking into account the functional play provided between their faces upon the assembly of two superimposed elements, is substantially equal to the length of the sleeve 17, as can be noted from FIG. 3. Thus, a sleeve 17 which is engaged in the counterbores 19 and 20 of two superimposed elements locks both of them in their direction precisely, while the tongues 7 and the grooves 8 lock them in their transverse direction, which makes the assembling of two superimposed elements in these two directions very easy and simple.

However, the sleeves 17 are not indispensable. Their centering and positioning function can be satisfied, although less precisely nevertheless sufficiently, by the threaded rod 16; in such case, the two counterbores 19 and 20 intended for the housing of these sleeves have no longer any reason for existence and can be dispensed with, which finally constitutes an advantageous economic solution when the cost factor is determinative.

The shoulder on the bottom of the lower counterbore 20 can also serve as resting rim for a washer 21 and a lock nut 22, for instance for the elements of the base of a wall, and the shoulder on the bottom of the upper counterbore 19 can also serve as supporting rim for the vertical locking of the stack of elements constituting the wall, with the use also of a washer and a nut.

It may be pointed out here parenthetically that particularly but not exclusively in the economical version without sleeves 17, the threaded vertical connecting rods 16 can be engaged in known manner by their lower ends being provided with a nut in a horizontal metallic profiled retaining member anchored in the foundation of the wall to be erected.

Two vertical holes 23 are provided on this element 6, in addition to the hole 11, for the possible passage of ducts.

Finally, all the elements of the set which comprise, as on this element 6, at least one female vertical dovetail slideway 9 on their two vertical faces also have, at right angles to it, two parallel transverse grooves 24 on their upper horizontal face 13 intended, at the wall junctions and angular connections, for the passage of the corresponding tongues 7 of the superimposed elements which are crossed with them.

Upon the assembling of a wall, all the elements of the same row are imbricated one after the other by interengagement of their female 9 and male 10 dovetail slideways located at their two ends, each element being threaded by its slideway from top to bottom in the corresponding slideway of the preceding element.

Thus all the assembled elements constituting a wall are self-locked with each other in all the three directions and are precisely and simply positioned as they are assembled.

In order to be able to produce without patchwork all the customary wall connections of L-shape, T-shape and X-shape and finally to be able to provide the openings corresponding to the windows and doors of the building whose walls are mounted by the assembling of elements according to the invention, and this while assuring an esthetic appearance of these walls, the six different types of elements shown diagrammatically in FIG. 4 have been designed in accordance with a well-defined rule of dimensional ratios and conformations as follows:

The elements of type 1, known as "short filling elements," are of square horizontal section and are provided on two opposite ends with their alternate dovetail vertical slideways, one female 9 at one end and the other one male 10 at the other end.

The elements of the second type 2, known as "short connecting elements," are also of square horizontal section, and are provided on their two ends and their two vertical faces with at least one female dovetail vertical slideway 9 and a central vertical hole 11 for the passage of a threaded rod and in addition, here, the housing for at least one connecting sleeve.

The elements of the third type 3, known as "medium connecting elements," are of rectangular horizontal section and each corresponds in volume and in conformation to the combining of a short filling element of the first type 1 with a short connecting element of the second type 2, this combining being made visible here by the dashed connecting line and the numbered braces.

The elements of the fourth type 4, known as "long filling elements," are of rectangular horizontal section and have at their two ends their male vertical dovetail slideways (10).

The elements of the fifth type 5, known as "long connecting elements" are of rectangular horizontal section and each corresponds in volume and conformation to the combining of a long filling element of the fourth type 4 with a short connecting element of the second type 2, this combining being also indicated here by the dashed connecting line and the numbered braces.

The elements of the sixth type 6, known as "double connecting" elements, are of rectangular horizontal section and each corresponds in volume and conformation to the end-to-end assembling in sequence of a long connecting element of the fifth type 5, a connecting element of the second type 2 to the exclusion of its central vertical hole 11, and a long filling element of the fourth type 4, this combining being also indicated by the dashed connecting lines and the numbered braces. This element of the sixth type furthermore has here the two holes 23 for the passage of ducts already mentioned and shown in FIGS. 1 and 2 but, depending on the type of building constructed, these holes may be dispensed with, as for instance in a set of elements intended for the construction of tool or machine sheds.

Since furthermore, the element 5 corresponds to the combining of an element 2 with an element 4, this element 6 can also correspond either to the end-to-end assembling of two elements 5 or to the end-to-end assembling in sequence of the elements 2+4+2+4 or else 2+4+5, the long filling element 4 serving as modulator of the aforementioned pitch P.

This affords the possibility, by using also elements of types 1 and 3, of reproducing this pitch P on each row of elements of a wall even plumb, independently of the openings such as doors or windows, as well as independently of the customary junction of the superimposed elements to the right of the corner of a building.

Figure 5:
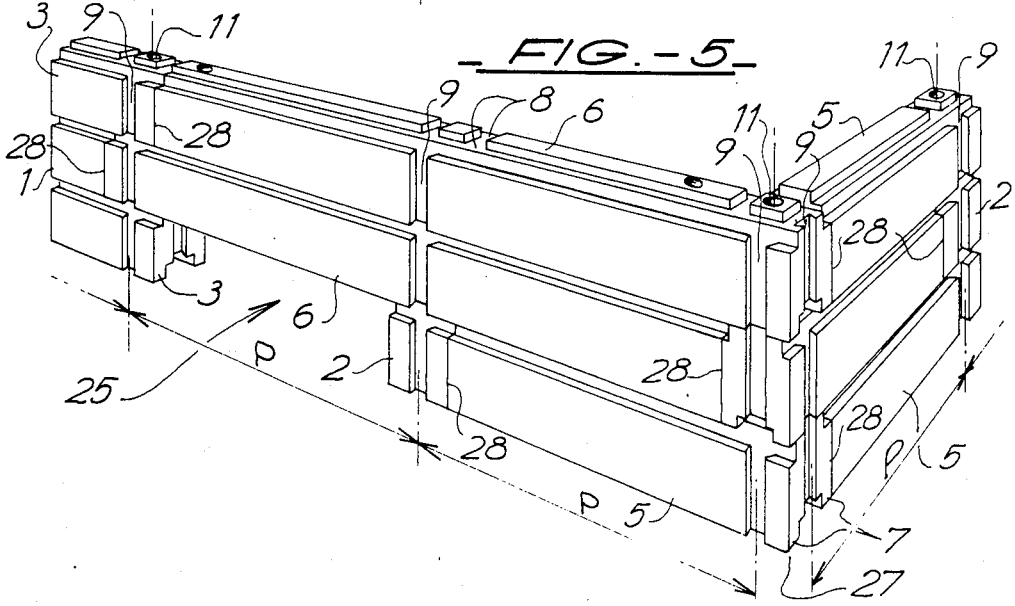
FIG. 5 is a perspective view of a portion of a wall resulting from the assembling of elements of most of these types.

FIG. 5 clearly shows this possibility. The portion of wall shown in this figure provides an example of an L-shaped connection of two walls, one of which has an opening 25.

This wall portion is produced by the assembling without retouching of elements of types 1, 2, 3,5 and 6. The vertical connecting bolts passing through the holes 11 of the connecting elements of this assembly have not been shown but it is obvious that these bolts are in place upon the assembling of the elements.

At the level of the connecting angle 27 of the two walls, elements of types 5 and 6 are crossed alternately at each row. The stagger thus created in their joint lines 28, which is repeated along these two walls, is here visually attenuated by the placing in preponderant appearance of the female vertical dovetail slideways 9 of the connecting elements 2, 3, 5 and 6 used in this assembly, which are aligned vertically with a regular spacing corresponding to the pitch P.

In fact, the visual discontinuity created by this stagger of the joint lines 28, which are of spatial dimensions far smaller than those of the slideways 9, passes practically unperceived and is replaced by an apparent continuity which is even further accentuated by the interplay of shadows and light, which, however, has not been shown in order not to clutter the drawing.

Of course, other combinations of the six types of elements are possible. They are adapted in each case to what is desired, depending on whether there are concerned solid walls or walls extensively pierced by openings as well as in accordance with the distance which separates an opening from the corner intersection of two walls, for instance by utilizing the different lengths of the filling elements 1 and 4 and the different lengths of the connecting elements 2, 3, 5 and 6.

At the top of the assembled wall, the threaded rods 16, which extend out, can serve in known manner for the vertical locking of a longitudinal cornice beam intended to support a floor or the trusses of a roof. However, due to the fact that the elements are self-locked to each other in the lengthwise direction of the wall by the interconnecting of their dovetail end slideways, it is advantageous to use a specially suitable wall element, for instance of the first type 1, having a transverse notch intended for the imbricating of a transverse floor beam or roof truss and a central vertical hole intended for the vertical locking of this beam by means of a threaded rod 16 and a nut, at the same time as that of the rows of superimposed elements plumb therewith. The spaces between the beams which are thus placed and secured can be filled by long filling elements of the fourth type 4, for instance. In order to facilitate the insertion of said beams in such special elements, the latter can be provided in two halves adapted to be assembled on opposite sides of each end of these beams, for instance by cementing or screwing.

The unitary structure in a single material, of the elements shown is not limitative and the dovetail slideways 9 and 10 can be doubled or even tripled in their place and stead.

Figure 6:
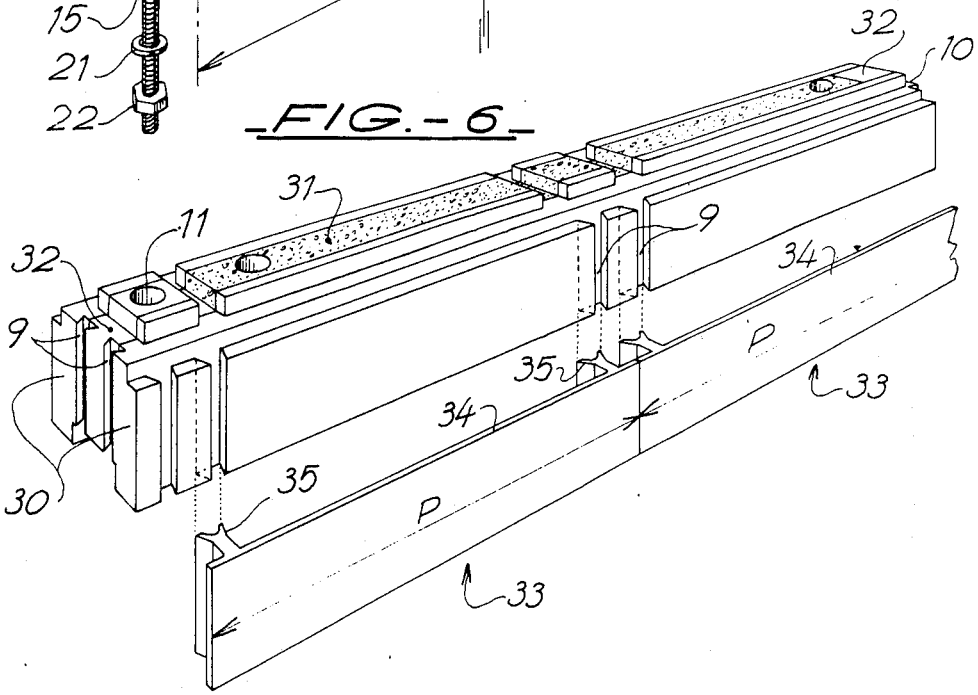
FIG. 6 is a perspective view of the variant.

A variant made of composite materials and double dovetail slideways is shown in FIG. 6. There is concerned here also an element of the sixth type, in order to facilitate comparison with the element 6 already described and shown in FIG. 1, which is particularly suitable for the construction of wooden vacation or mountain cottages, for which good insulation of the walls is required.

This element is formed, in a manner known per se, of two parallel lateral walls 30 between which there is sandwiched a central core 31 of expanded synthetic material, these two walls being connected at their ends by two studs 32 of solid wood in which there are developed the double dovetail slideways, female 9 and male 10, as well as the hole 11 for the passage of the bolt 16 and the housing of the sleeve 17.

The geometrical conformation of this element of type 6, aside from the doubling of the dovetail slideways 9 and 10, is identical to that of the element of the same type shown in FIG. 1.

However here, the doubling of the female dovetail slideways 9 has the advantage of permitting the coupling, on the inner as well as outer vertical faces, to the building formed of the elements of this shape, of facing or insulating plates 33 which can be made in economical manner and placed on without the need for of retouch work. In fact, due to the constant nature and repetitiousness of the pitch P which separates the double slideways here, these plates 33 can be prefabricated in accordance with an identical conformation having a flat portion 34 of a length corresponding to this pitch P and two vertical end portions in the form of male dovetail slideways 35 partially cut out, for instance, in their cross section, and intended to be introduced by squeezing into the corresponding female dovetail slideways 9 of the connecting elements developed in accordance with this variant.

A corner facing, not shown in the drawing, can be provided in such a manner that each of its two right-angles portions intended to form an extension, on each side of said angle, of the flat walls 34 of the facings 33 of the two continguous walls, such as those shown in this FIG. 6, have male dovetail slideways of the same type as the slideways 35, adapted to be introduced, also by squeezing, into the female slideways 9 of the element forming the angle of these two walls. When the female vertical dovetail slideways 9 are single and not double, as in the case of the element 6 shown in FIG. 1, it is also possible to insert in these slideways 9 a facing formed, for instance, of a profiled insert of high-quality wood or any other desired material.

It can be noted here that in this case, as furthermore in that of the facings 33 shown in FIG. 6, the female dovetail slideways 9 of the elements can also serve for the prior insertion of electrical wires which are then covered by the facings in question, which is of interest for the inner faces of the walls.

The conformation shown by way of example of the tongues 7 and grooves 8 is not limitative and any other conformation can be used without going beyond the scope of the invention, such as, for instance, a known one having the appearance of the assembling of Canadian slabs or else an edge-to-edge conformation with single visible joint line.

The conformation of the male dovetail vertical slideways 10 need not be integrated upon construction in the elements of the first, fourth, fifth and sixth types.

Figure 7:
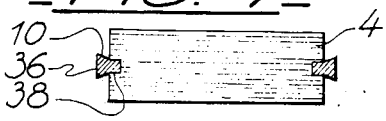
FIGS. 7 and 8 are two partial top views of two variants of the special conformation of certain elements.
Figure 8:
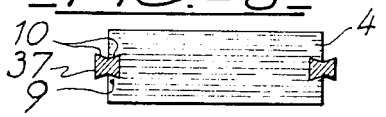

The variant conformations of these slideways shown in FIGS. 7 and 8 are formed of profiled memebers 36 and 37 attached to an element of type 4, selected by way of example.

In FIG. 7, the profiled member 36 has a cross section which results from the of the protruding section of the male dovetail 10 with a rectangular interengagement dovetail 38 which is glued in a vertical groove of corresponding rectangular section produced upon the manufacture of the element 4. This conformation makes it possible, for instance when the set of elements is made of wood, to avoid the fragility of an integrated male slideway which, as a result of this integration, would be structured with the grain of the wood crosswise over its vertical extent. This conformation also makes it possible to avoid difficult protrusion machining on the end of the element.

In FIG. 8, the profiled member 37 is removable and for this purpose has a double male dovetail cross section 10 the midsection of which is engaged with a slightly hard force-fit in a female dovetail slideway 9 integrated in the element 4. This removable conformation also makes it possible, when the set is made of wood, to avoid difficult end machining of the element, but it also makes it possible to avoid the risks of damage to the protruding male slideway 10 upon the handling and transportation of the parts having them. In fact, these removable slideways 27 can travel and be handled grouped in bags, independently of the elements, before being connected to the latter, for instance prior to their assembly.

Of course, these profiled members 36 and 37 can be made of any material other than wood, for instance of plastic.

The dovetail shape given by way of example to the parallel vertical attachment slideways 9 and 10 is obviously not limitative and any other form of equivalent coupling shape can be used, such as, for instance, a T shape or a capital omega shape.

The materials used for the production of the elements may be of any customary type. However, in order to achieve the desired advantage of simplicity in handling and assembling, the length of the largest of them, that of the sixth type, will be adapted to the density of the material employed, so as to obtain a reasonable unit weight which can be handled by a person of average strength without the use of any carrying device.

I claim:

1. A set of modular elements for the construction of building walls, having the shape of rectangular parallelepipeds, of the same height and width, of different lengths and types and comprising connecting and/or retaining conformations formed of grooves and tongues of complementary sections and of vertical recesses or passages intended for additional vertical connecting elements formed of threaded rods, connecting sleeves, washers and lock nuts, characterized by the fact that it comprises six types of different elements (1 to 6) all having in common, on the longitudinal edges of their upper and lower horizontal faces, complementary interengagement longitudinal tongues (7) and grooves (8) forming transverse retainers and sealing conformation and at least one parallel vertical coupling slideway (9, 10) at each end intended for their interlacing and their mutual coupling in their lengthwise direction, by the fact that the elements of the first type (1) known as "short filling elements" are of square horizontal section and have on two opposite ends their alternate parallel coupling vertical slideways, one female (9) at one end and the other male (10) at the other end; by the fact that the elements of the second type (2) known as "short connecting elements" are also of square horizontal section, having on their two ends and their two vertical faces at least one female parallel coupling vertical slideway (9) and a central vertical hole (11) for the passage of a vertical threaded connecting rod; by the fact that the elements of the third type (3) known as "medium connecting elements" are of rectangular horizontal section, each corresponding in volume and in confirmation to the assembly of a short filling element of the first type (1) with a short connecting element of the second type (2); by the fact that the elements of the fourth type (4) known as "long filling elements," are of rectangular horizontal section and have at their two ends their vertical parallel-locking slideways in male conformation (10); by the fact that the elements of the fifth type (5) known as "long connecting elements" are of rectangular horizontal section, each corresponding in volume and in conformation to the combination of a long filling element of the fourth type (4) with a short connecting element of the second type (2); by the fact that the elements of the sixth type (6) called "double connecting elements" are of rectangular horizontal section, each corresponding in volume and in conformation to the end-to-end combination in sequence of a long connecting element of the fifth type (5), a connecting element of the second type (2) with the exception of its central vertical hole (11), and a long filling element of the fourth type (4); and by the fact that the connecting elements of the second (2), third (3), fifth (5) and sixth (6) type all have, at their female parallel coupling vertical slideways (9) and on their horizontal faces having longitudinal grooves (8), transverse cuts (24) intended, at the junctions and angular connections of walls, for the passage of the corresponding tongues (7) of the elements which are crosswise to them.

2. A set according to claim 1, characterized by the fact that the male parallel coupling vertical slideways (10) which the elements of the first, fourth, fifth and sixth types (1, 4, 5, 6) have are formed of profiled members (36, 37) which are attached to said elements.

3. A set according to claim 2, characterized by the fact that the attached profiled members are removable and formed of inserts of a cross section with a double parallel coupling male slideway (37) the midsection of which is engaged in a corresponding female slideway (9) of the element in question.

* * * * *